US007362080B2

(12) United States Patent
Sohn et al.

(10) Patent No.: US 7,362,080 B2
(45) Date of Patent: Apr. 22, 2008

(54) POWER REGULATOR HAVING OVER-CURRENT PROTECTION CIRCUIT AND METHOD OF PROVIDING OVER-CURRENT PROTECTION THEREOF

(75) Inventors: Il-Young Sohn, Hwaseong-si (KR); Dong-Jin Keum, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 185 days.

(21) Appl. No.: 11/207,698

(22) Filed: Aug. 20, 2005

(65) Prior Publication Data

US 2006/0043945 A1 Mar. 2, 2006

(30) Foreign Application Priority Data

Aug. 27, 2004 (KR) ..... 10-2004-0067677

(51) Int. Cl.
*G05F 1/573* (2006.01)

(52) U.S. Cl. ..... 323/277; 323/279

(58) Field of Classification Search ..... 323/273, 323/274, 277, 279
See application file for complete search history.

(56) References Cited

U.S. PATENT DOCUMENTS 6,452,766 B1 9/2002 Carper ..... 361/18
6,522,111 B2 * 2/2003 Zadeh et al. ..... 323/277
6,664,773 B1 * 12/2003 Cunnac et al. ..... 323/277
6,870,351 B2 * 3/2005 Sugimura ..... 323/277
7,173,401 B1 * 2/2007 Huang ..... 323/277
7,183,755 B2 * 2/2007 Itoh et al. ..... 323/274

FOREIGN PATENT DOCUMENTS

JP 03-136112 6/1991
JP 2002-157031 5/2002
KR 2002-43345 6/2002

* cited by examiner

*Primary Examiner*—Jeffrey Sterrett
(74) *Attorney, Agent, or Firm*—F. Chau & Associates, LLC.

(57) ABSTRACT

A power regulator includes a pass transistor, a feedback circuit, an error amplifier and a protection circuit. The pass transistor receives an unregulated first power supply voltage, and an output terminal of the power regulator outputs an output voltage varying depending upon a control signal. The feedback circuit senses a current flowing through the pass transistor and generates a feedback signal. The error amplifier compares a reference signal to the feedback signal and generates a control signal varying depending upon a voltage difference between the reference signal and the feedback signal. The protection circuit scales down a current flowing through the pass transistor by a prescribed ratio and changes a voltage of the control signal when the scaled-down current has a value higher than a prescribed value. Accordingly, the power regulator may control a current limit correctly and be capable of implementing a sensing resistor having an appropriate resistance value for providing over-current protection that occupies a smaller chip area.

11 Claims, 6 Drawing Sheets

POWER REGULATOR HAVING OVER-CURRENT PROTECTION CIRCUIT AND METHOD OF PROVIDING OVER-CURRENT PROTECTION THEREOF

CROSS-REFERENCE TO RELATED APPLICATION

This application claims priority to Korean Patent Application No. 2004-67677, filed on Aug. 27, 2004, the content of which is hereby incorporated by reference in its entirety.

BACKGROUND OF THE INVENTION

1. Field of the Invention

The present invention relates to a regulator and in particular to a low dropout regulator having an over-current protection circuit capable of preventing an overcurrent from flowing through the regulator.

2. Description of the Related Art

A regulator converts an unstable power supply voltage into a stable power supply voltage. A low dropout (LDO) regulator has a low input-to-output voltage difference between an input terminal where an unstable power supply voltage is inputted and an output terminal where a stable power supply voltage is outputted. "Dropout voltage" refers to the input-to-output voltage difference at which the regulator ceases to regulate against further reductions in input voltage. Ideally, the dropout voltage should be as low as possible, to allow the input voltage to be relatively low and still maintain regulation. This assures that the input-to-output voltage difference is low, minimizing power dissipation and maximizing efficiency.

FIG. 1 is a circuit diagram illustrating a conventional LDO regulator. Referring to FIG. 1, the typical LDO regulator circuit includes a reference voltage generator 200, an error amplifier 100, a pass transistor MP1, and resistors R1 and R2.

An unregulated power supply voltage VIN is applied to a source terminal of the pass transistor MP1. The current flowing through the pass transistor MP1 flows through the resistors R1 and R2 and then flows to ground GND. A regulated power supply voltage VOUT is outputted to an output terminal coupled to a drain terminal of the pass transistor MP1.

A reference voltage Vref outputted from the reference voltage generator 200 is applied to the inverted input terminal of the error amplifier 100, and a voltage Vf across the resistor R2 is applied into the non-inverted input terminal of the error amplifier 100, as shown in FIGS. 1 and 2. An output signal VEO of the error amplifier 100 is applied into a gate of the pass transistor MP1. The current flowing through the pass transistor MP1 is sensed by the resistor R2 and converted into a voltage signal Vf.

The voltage signal Vf is inputted into the non-inverted input terminal of the error amplifier 100 and is compared to the reference voltage Vref. The output voltage VOUT may be represented as $VOUT=Vref\times((1+Rf)/Rf)$. The reference voltage Vref is a stable voltage and, therefore, the output voltage VOUT is a stable voltage.

Generally, the conventional LDO regulator includes a protection circuit such as an over-current protection circuit so as to protect the circuit during abnormal operating conditions. For example, FIG. 2 is a circuit diagram illustrating a conventional low dropout regulator for providing over-current protection. Referring to FIG. 2, the LDO regulator for providing over-current protection includes a protection circuit composed of a resistor RS1 and a PMOS transistor MP2, in addition to the circuit components illustrated in FIG. 1.

During abnormal operating conditions, when an unregulated power supply voltage VIN increases, the current flowing through the pass transistor MP1 overly increases and a voltage VRS1 across the resistor RS1 increases. When the voltage VRS1 across the resistor RS1 is larger than a threshold voltage of the PMOS transistor MP2, the PMOS transistor is turned on. An electric potential of a gate of the pass transistor MP1 becomes high and a current flowing through the pass transistor MP1 decreases. Accordingly, although the unregulated power supply voltage VIN overly increases, the pass transistor MP1 may be protected using the protection circuit composed of the resistor RS1 and the PMOS transistor MP2.

However, when the load current is about 100 mA, the voltage dropout between the input and output terminals of the LDO regulator is about 100 mV to about 200 mV. This means that the resistor RS1 needs to have a resistance value below 1 ohm. Implementing the resistor RS1 having a resistance below 1 ohm occupies a large area in a semiconductor chip.

SUMMARY OF THE INVENTION

Exemplary embodiments of the present invention provide an over-current protection circuit capable of preventing an overcurrent from flowing through a power regulator.

Exemplary embodiments of the present invention provide a power regulator having an over-current protection circuit capable of implementing a sensing resistor of the over-current protection circuit that occupies a small chip area in a semiconductor integrated circuit (IC).

Exemplary embodiments of the present invention also provide a method of providing an over-current protection of a power regulator capable of implementing a sensing resistor of the over-current protection circuit that occupies a small chip area in a semiconductor integrated circuit (IC).

In various exemplary embodiments of the present invention, there is provided a power regulator including a pass transistor, a feedback circuit, an error amplifier and a protection circuit. The pass transistor receives an unregulated first power supply voltage to generate a regulated output voltage varying depending upon a control signal. The feedback circuit detects a first current flowing through the pass transistor and generates a feedback signal. The error amplifier generates the control signal varying depending upon a voltage difference between a reference signal and the feedback signal. The protection circuit scales down the first current flowing through the pass transistor by a predetermined ratio to generate a second current and changes a voltage level of the control signal when the scaled-down second current has a value above a predetermined value.

In various exemplary embodiments of the present invention there is provided an over-current protection circuit in a power regulator comprising: a scale down circuit configured to scale down a first current flowing through a pass transistor by a predetermined ratio; a mirror circuit configured to generate a mirror current of the scaled-down current; and a current detection circuit configured to detect a second current corresponding to the mirror current of the scaled-down current and configured to increase a voltage of a control signal of the pass transistor when the detected second current has a value higher than a predetermined value.

In various exemplary embodiments of the present invention, there is provided a method of providing an over-current protection in a power regulator including: receiving a power supply voltage to output an output voltage to an output terminal of a power regulator by changing a first current flowing through a pass transistor in response to a control signal, the output voltage being substantially proportional to the first current flowing through the pass transistor; detecting the first current flowing through the pass transistor to generate a feedback signal; generating the control signal that varies depending upon voltage a difference between a reference signal and the feedback signal; scaling down the first current flowing through the pass transistor by a predetermined ratio; and detecting the scaled-down current to increase a voltage level of the control signal when the detected scaled-down second current has a value higher than a predetermined value.

BRIEF DESCRIPTION OF THE DRAWINGS

The present invention will become more apparent to those of ordinary skill in the art when descriptions of exemplary embodiments thereof are read with reference to the accompanying drawings, of which.

DETAILED DESCRIPTION OF EXEMPLARY EMBODIMENTS

Figure 1:
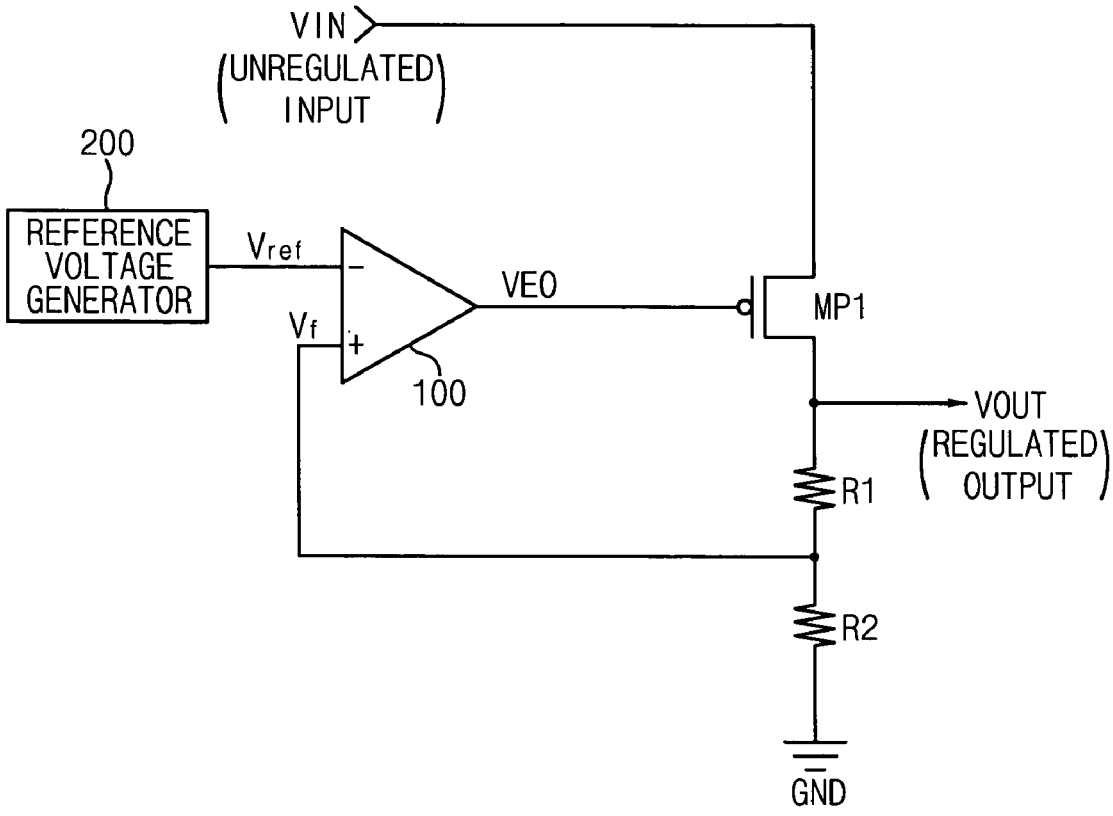
FIG. 1 (PRIOR ART)
FIG. 1 is a circuit diagram illustrating a conventional low dropout (LDO) regulator.

Hereinafter, the present invention will be described in detail with reference to the accompanying drawings. However, specific structural and functional details disclosed herein are merely representative for purposes of describing exemplary embodiments of the present invention. The present invention may be embodied in numerous alternate forms and should not be construed as limited to the exemplary embodiments set forth herein. It should be understood that the intention is to cover all modifications, equivalents, and alternatives falling within the spirit and scope of the invention. Like reference numerals refer to like elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

Figure 3:
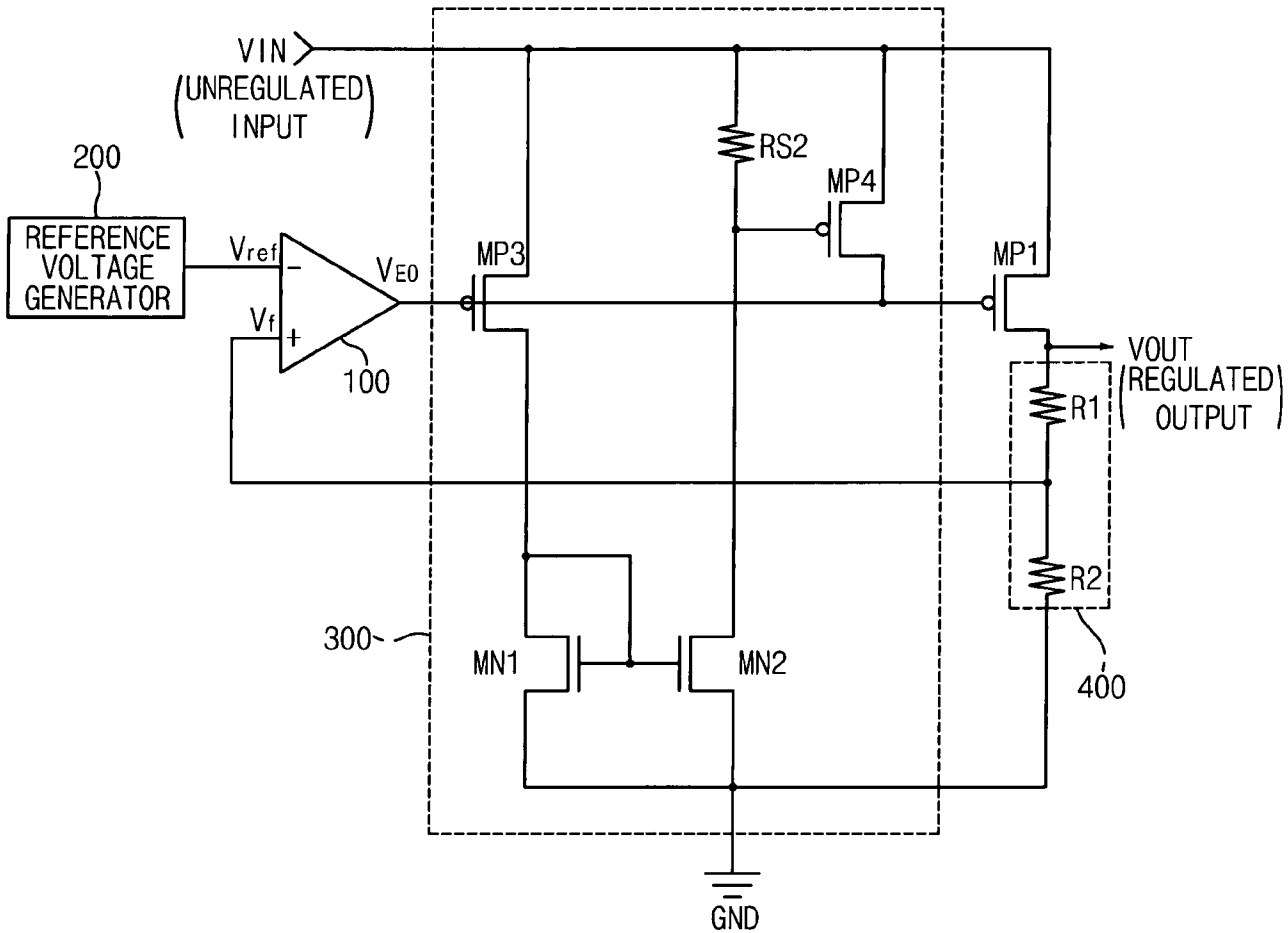
FIG. 3 is a circuit diagram illustrating a LDO regulator for providing over-current protection according to a first exemplary embodiment of the present invention.

FIG. 3 is a circuit diagram illustrating a LDO regulator for providing over-current protection according to a first exemplary embodiment of the present invention. Referring to FIG. 3, a LDO regulator includes a pass transistor MP1, a feedback circuit 400, a reference voltage generator 200, an error amplifier 100 and a protection circuit 300.

The feedback circuit 400 includes resistors R1 and R2. An unregulated power supply voltage VIN is applied to a power line. The pass transistor MP1 receives the unregulated power supply voltage VIN and generates an output voltage VOUT that varies depending upon a control signal VEO. The feedback circuit 400 detects a current flowing through the pass transistor MP1 and generates a feedback signal Vf. The output voltage VOUT is divided by the resistors R1 and R2, and the divided voltage signal of the output voltage VOUT becomes the feedback signal Vf.

The error amplifier 100 compares a reference signal Vref to the feedback signal Vf and generates the control signal VEO that varies depending upon the voltage difference between the reference signal Vref and the feedback signal Vf.

The reference voltage generator 200 generates a stable reference voltage Vref regardless of manufacturing process variation and/or temperature variation.

The protection circuit 300 scales down a current flowing through the pass transistor MP1 by a predetermined ratio and detects the scaled-down current. Additionally, the protection circuit 300 increases a voltage level of the control signal VEO when the detected scaled-down current is larger than or equal to a predetermined value.

The protection circuit 300 according to the first exemplary embodiment of the present invention includes PMOS transistors MP3 and MP4, NMOS transistors MN1 and MN2, and a resistor RS2, as shown in FIG. 3. The PMOS transistor MP3 has a gate coupled to a gate of the pass transistor MP1 and a source coupled to the power line supplied with the unregulated power supply voltage VIN. The NMOS transistor MN1 has a gate and drain commonly coupled to a drain of the PMOS transistor MP3, and a source coupled to a ground GND. The NMOS transistor MN2 has a gate coupled to a gate of the NMOS transistor MN1 and a source coupled to ground GND. The resistor RS2 is coupled between the unregulated power supply voltage VIN and the drain of the NMOS transistor MN2. The PMOS transistor MP4 has a source coupled to the unregulated power supply voltage VIN, a gate coupled to the drain of the NMOS transistor MN2, and a drain coupled to the gate of the pass transistor MP1.

Hereinafter, with reference to FIG. 3, operation of the LDO regulator for an over-current protection according to a first exemplary embodiment of the present invention is described.

The unregulated power supply voltage VIN applied to a power line may be a battery voltage used for a mobile phone. The pass transistor MP1 performs a switch operation under the control of the control signal VEO outputted from the error amplifier 100, and the pass transistor MP1 generates an output voltage VOUT varying depending upon the control signal VEO.

The feedback signal Vf is the divided signal of the output voltage VOUT divided by the resistors R1 and R2 that constitute the feedback circuit 400, as shown in FIG. 3. The error amplifier 100 compares the reference voltage signal Vref outputted from the reference voltage generator 200 to the feedback signal Vf to output the control signal Veo.

When a current flowing through the pass transistor MP1 increases, the output voltage VOUT increases and a voltage across the resistor R2 increases. As a result, the feedback signal Vf increases. When the feedback signal Vf increases, the control signal VEO outputted from the error amplifier 100 increases, and a current flowing through the pass transistor MP1 decreases. When a current flowing through the pass transistor MP1 decreases, the output voltage VOUT decreases and a voltage across the resistor R2 decreases. As a result, the feedback signal Vf decreases. When the feedback signal Vf decreases, the control signal VEO outputted from the error amplifier 100 decreases, and a current flowing through the pass transistor MP1 increases. Therefore, the output voltage VOUT is stabilized.

Hereinafter, operation of the protection circuit 300 according to various exemplary embodiments of the present invention will be described with reference to FIG. 3. The NMOS transistors MN1 and MN2 form a current mirror. A current flowing through the PMOS transistor MP3 is proportional to a current flowing through the pass transistor MP1 since a gate of the PMOS transistor MP3 is coupled to the gate of the pass transistor MP1. The transistor size (channel width/channel length) of the pass transistor MP1 is about tens of thousands of times larger than a transistor size (channel width/channel length) of a normal PMOS transistor. A current on the order of hundreds of mA flows through the pass transistor MP1.

However, the PMOS transistor MP3 may be designed to have a transistor size similar to that of a normal PMOS transistor; therefore, a current on the order of several uA to scores of uA may flow through the PMOS transistor MP3.

A drain of the NMOS transistor MN2 has a current value equal to a current flowing through the PMOS transistor MP3 since the NMOS transistor MN1 and MN2 form a current mirror. A current flowing through the drain of the NMOS transistor MN2 is converted into a voltage by the resistor RS2. A voltage across the resistor RS2 is applied to a gate of the PMOS transistor MP4.

When an over-current condition occurs, since an unregulated power supply voltage VIN overly increases, a relatively large current flows through the pass transistor MP1. The current is sensed by the PMOS transistor MP3 and the resistor RS2. When a current flowing through the pass transistor MP1 overly increases, a voltage across the resistor RS2 largely increases. Consequently, a gate-to-source voltage of the PMOS transistor MP4 increases and the PMOS transistor MP4 is turned on.

The drain of the PMOS transistor MP4 is coupled to the gate of the pass transistor MP1, therefore, when the PMOS transistor MP4 is turned on, a gate voltage of the pass transistor MP1 becomes high. Accordingly, the pass transistor MP1 is turned off or operates below the threshold voltage.

As illustrated in FIG. 3, the LDO regulator for providing over-current protection according to the second exemplary embodiment of the present invention does not directly detect a large current (for example, a large current has a unit of mA) flowing through the pass transistor MP1; however, the LDO regulator scales down the large current flowing through the pass transistor MP1, and the scaled-down current is detected by the resistor RS2 of the protection circuit 300. Therefore, the resistor RS2 used for sensing a current may be designed to have a higher resistance value than that of a resistor included in the conventional LDO regulator.

Figure 2:
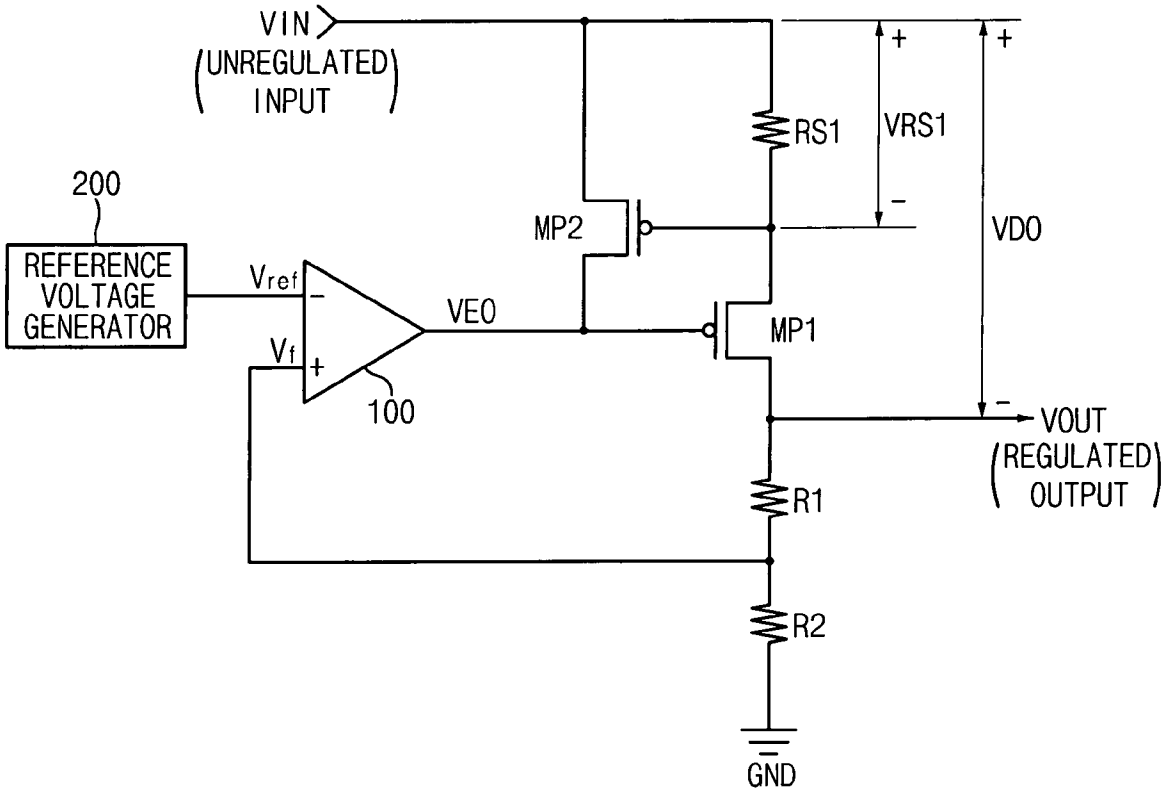
FIG. 2 (PRIOR ART)
FIG. 2 is a circuit diagram illustrating a conventional LDO regulator for providing over-current protection.

Referring to FIG. 2, the conventional LDO regulator circuit directly detects a large current flowing through the pass transistor MP1. Therefore, since the LDO regulator has to maintain a low dropout voltage, the resistor RS1 shown in FIG. 2 for sensing a current was designed to have a resistance value below 1 ohm. However, a resistor having a resistance below 1 ohm occupies a large area in a semiconductor chip.

Figure 4:
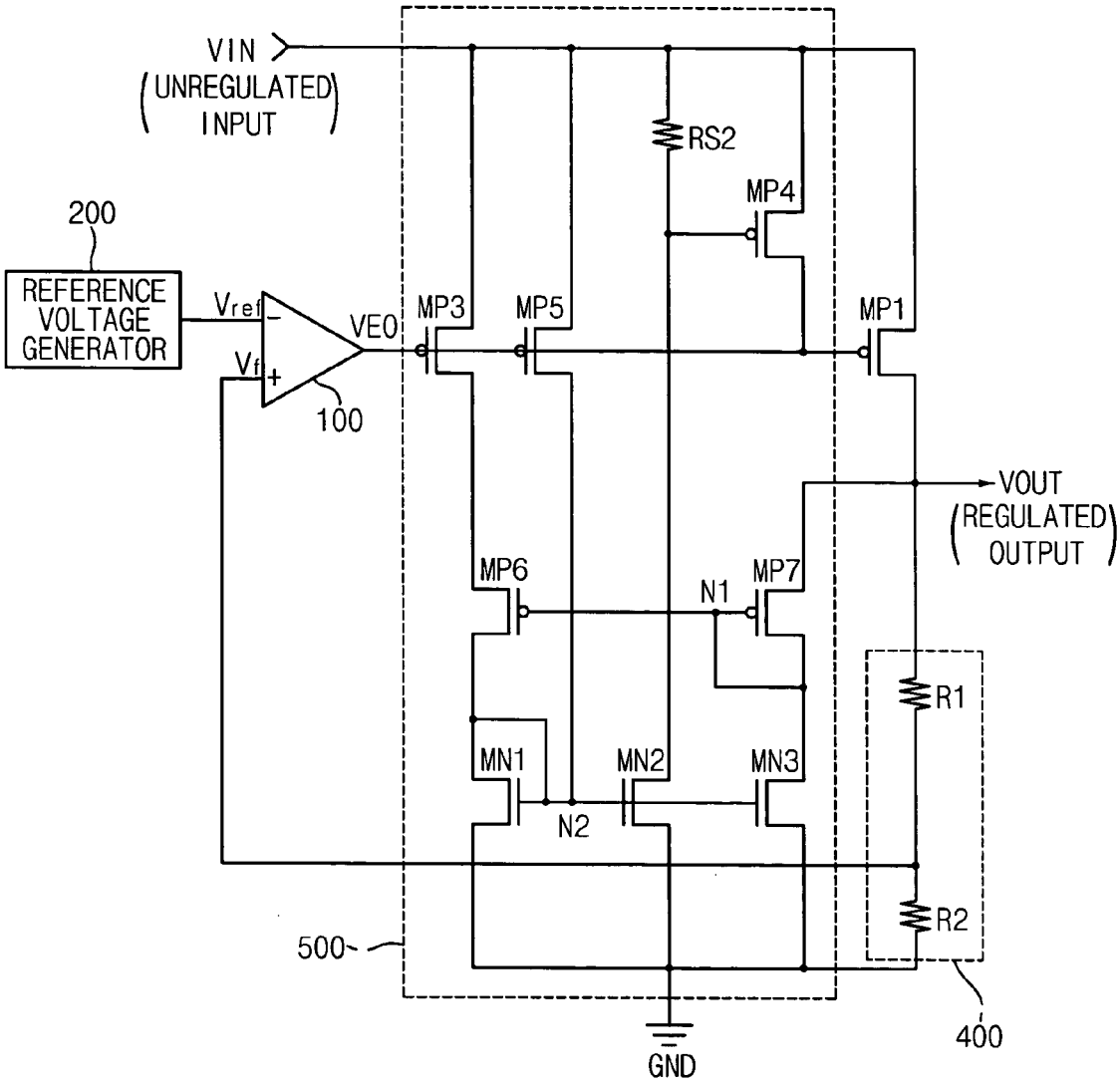
FIG. 4 is a circuit diagram illustrating a LDO regulator for providing over-current protection according to a second exemplary embodiment of the present invention.

FIG. 4 is a circuit diagram illustrating a LDO regulator for providing over-current protection according to a second exemplary embodiment of the present invention. Referring to FIG. 4, the LDO regulator includes a pass transistor MP1, a feedback circuit 400, a reference voltage generator 200, an error amplifier 100 and a protection circuit 500. The feedback circuit 400 includes resistors R1 and R2.

The protection circuit 500 includes PMOS transistors MP3, MP4, MP5, MP6 and MP7, NMOS transistors MN1, MN2 and MN3, and a resistor RS2. The PMOS transistor MP3 has a gate coupled to a gate of the pass transistor MP1 and a source coupled to a power supply voltage. The PMOS transistor MP6 has a source coupled to a drain of the PMOS transistor MP3, a gate coupled to a node N1 and a drain coupled to a node N2. The PMOS transistor MP7 has a source coupled to an output terminal of the regulator, and a gate and drain commonly coupled to the node N1.

The NMOS transistor MN1 has a gate and drain commonly coupled to the node N2, and a source coupled to ground GND. The NMOS transistor MN2 has a gate coupled to a gate of the NMOS transistor MN1 and a source coupled to ground GND.

The NMOS transistor MN3 has a gate coupled to the gate of the NMOS transistor MN2, a drain coupled to the node N1 and a source coupled to ground GND. The resistor RS2 is coupled between a power line having an unregulated power supply voltage VIN and the drain of the NMOS transistor MN2. The PMOS transistor MP4 has a source coupled to the power line, a gate of the drain of the NMOS transistor MN2 and a drain coupled to a controlelectrode of the pass transistor MP4.

Hereinafter, operation of the protection circuit 500 according to a second exemplary embodiment of the present invention is described with reference to FIG. 4. The protection circuit 500 of the LDO regulator illustrated in FIG. 4 includes a feedback loop composed of a NMOS transistor MN3, a PMOS transistor MP6 and a PMOS transistor MP7, in addition to the components of the protection circuit 300 of the LDO regulator according to the first exemplary embodiment of the present invention as illustrated in FIG. 3.

Like the protection circuit 300 of FIG. 3, a gate of the PMOS transistor MP3 is coupled to a gate of the pass transistor MP1; therefore, a current flowing through the PMOS transistor MP3 is proportional to a current flowing through the pass transistor MP1.

The size (width/length) of the PMOS transistor MP3 is designed to be several thousandths or several ten-thousandths of the size of the pass transistor MP1. A current on the order of several uA to scores of uA flows through the PMOS transistor MP3.

A current flowing through a drain of the NMOS transistor MN2 is equal to a current flowing through the PMOS transistor MP3 since a NMOS transistor MN1 and a NMOS transistor MN2 form a current mirror. A current flowing through the drain of the NMOS transistor MN2 is converted into a voltage by the resistor RS2. A voltage drop across the resistor RS2 is applied into a gate of the PMOS transistor MP4.

The electric potential of the drain of the pass transistor MP1 is substantially equal to that of the drain of the PMOS transistor MP3 due to the feedback path composed of the NMOS transistor MN3, the PMOS transistor MP6 and the PMOS transistor MP7.

Consequently, in the protection circuit 500 according to the second exemplary embodiment of the present invention, current mismatching due to a voltage difference between a drain-to-source voltage of the pass transistor MP1 and a drain-to-source voltage of the PMOS transistor MP3 may be prevented.

The PMOS transistor MP5 of FIG. 4 provides a trigger voltage to a node N2 so as to trigger the current mirror circuit comprised of transistors MN1 and MN2.

Figure 5:
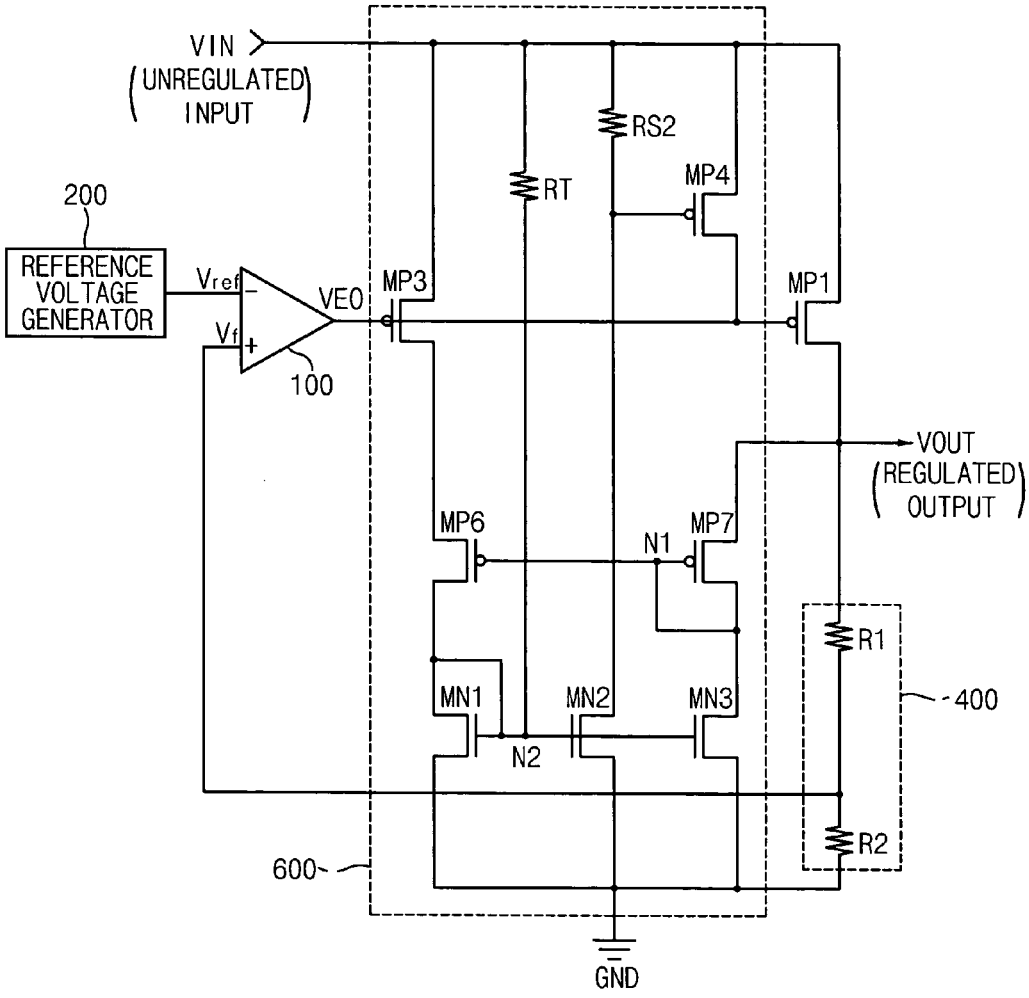
FIG. 5 is a circuit diagram illustrating a LDO regulator for providing over-current protection according to a third exemplary embodiment of the present invention.

FIG. 5 is a circuit diagram illustrating a LDO regulator for providing over-current protection according to a third exemplary embodiment of the present invention. The protection circuit 600 of FIG. 5 uses a resistor RT, instead of the PMOS transistor MP5 shown in FIG. 4, so as to trigger the current mirror circuit comprised of transistors MN1 and MN2. The resistor RT is coupled between a power line and a node N2 to trigger the mirror circuit (MN1 and MN2) of the protection circuit 600. Operation of the LDO regulator illustrated in FIG. 5 is similar to the operation of the LDO regulator illustrated in FIG. 4. Therefore, description of the operation of the LDO regulator in FIG. 5 will be omitted.

Figure 6:
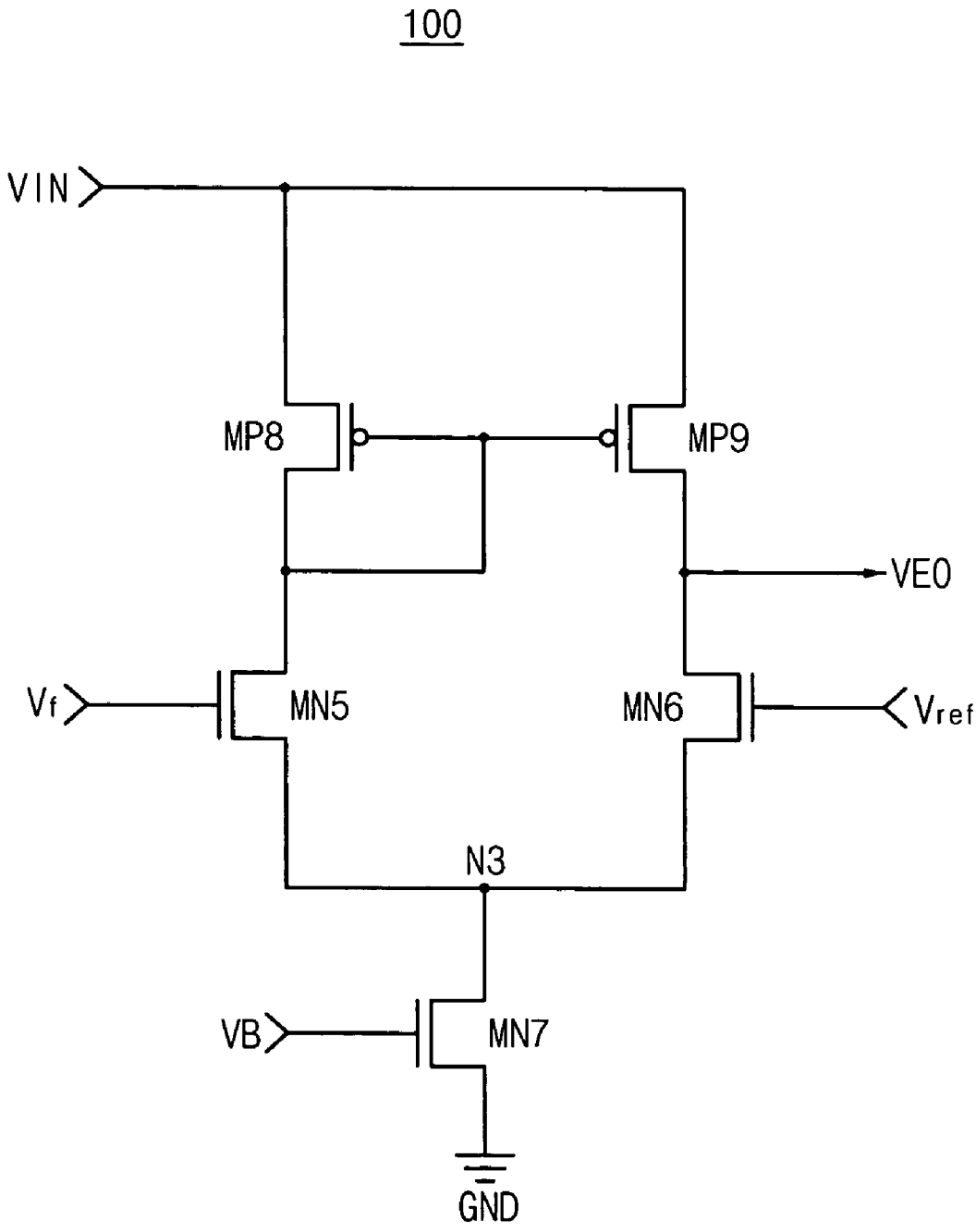
FIG. 6 is a circuit diagram illustrating an error amplifier used in the LDO regulators illustrated in FIGS. 3 through 5 according to various exemplary embodiments of the present invention.

FIG. 6 is a circuit diagram illustrating an error amplifier used in the LDO regulators illustrated in FIGS. 3 to 5 according to various exemplary embodiments of the present invention. Referring to FIG. 6, the error amplifier 100 includes PMOS transistors MP8 and MP9, and NMOS transistors MN5, MN6 and MN7. The error amplifier 100 is coupled to the unregulated power supply voltage VIN as a power supply voltage.

The PMOS transistor MP8 has a source coupled to a power line to which an unregulated power supply voltage VIN is applied, a drain and gate commonly coupled to each other. The PMOS transistor MP8 has a source coupled to the power line, a gate coupled to a gate of the PMOS transistor MP8 and a drain where the output signal VEO of the error amplifier 100 is outputted.

The NMOS transistor MN5 has a drain coupled to a drain of the PMOS transistor MP8, a gate where the feedback signal Vf is applied and a source coupled to a node N3. The NMOS transistor MN6 has a drain coupled to a drain of the PMOS transistor MP9, a gate where the reference signal Vref is applied and a source coupled to a node N3. The NMOS transistor MN7 has a drain coupled to the node N3, a gate where a bias voltage is applied and a source coupled to ground GND.

Hereinafter, operation of the error amplifier 100 according to an exemplary embodiment of the present invention will be described with reference to FIG. 6. A voltage VIN is an unregulated power supply voltage and may be a battery voltage used for a mobile phone, etc. When a feedback signal Vf is higher than a reference signal Vref, the error amplifier 100 outputs a positive output signal VEO, and when the feedback signal Vf is lower than the reference signal Vref, the error amplifier 100 outputs a negative output signal VEO.

Referring to the LDO regulator according to the first embodiment of the present invention as shown in FIG. 3, when a current flowing through the pass transistor MP1 increases, a voltage drop across the resistor R2 increases and the feedback signal Vf increases. As a result, the output signal VEO of the error amplifier increases. Whereas, when a current flowing through the pass transistor MP1 decreases, a voltage across the resistor R2 decreases and the feedback signal Vf decreases; as a result, the output signal VEO of the error amplifier decreases.

Therefore, the power regulator according to the exemplary embodiments of the present invention may prevent an overcurrent from flowing through the power regulator.

Additionally, the power regulator according to the exemplary embodiments of the present invention may implement a sensing resistor of an over-current protection that occupies a smaller chip area in a semiconductor integrated circuit (IC).

While the processes and apparatus of the present invention have been described in detail for the purpose of illustration, the inventive processes and apparatus are not to be construed as limited thereby. It will be readily apparent to those of reasonable skill in the art that various modifications to the foregoing exemplary embodiments can be made without departing from the spirit and scope of the invention as defined by the appended claims.

What is claimed is:

1. A power regulator comprising:

a pass transistor configured to receive an unregulated first power supply voltage to generate a regulated output voltage varying depending upon a control signal, wherein the pass transistor comprises a first PMOS transistor having a gate coupled to an output terminal of the error amplifier, a source coupled to the first power supply voltage and a drain coupled to an output terminal of the power regulator;

a feedback circuit configured to generate a feedback signal;

an error amplifier configured to generate the control signal varying depending upon a voltage difference between a reference signal and the feedback signal;

a protection circuit configured to scale down a first current flowing through the pass transistor by a predetermined ratio to generate a second current and configured to change a voltage level of the control signal when the scaled-down second current has a value above a predetermined value; and a feedback loop coupled to a mirror circuit, the pass transistor and a current match transistor, the feedback loop including:

a second PMOS transistor having a gate coupled to a first node and a drain coupled to a second node;

a third PMOS transistor having a source coupled to a drain of the first PMOS transistor, and a gate and drain commonly coupled to the first node; and a first NMOS transistor having a gate coupled to the mirror circuit, a drain coupled to the first node and a source coupled to the feedback circuit.

2. The power regulator of claim 1, wherein the feedback circuit includes a first resistor and a second resistor serially coupled between an output terminal of the power regulator and the second power supply voltage, and the feedback signal is outputted from a coupled point of the first resistor and the second resistor.

3. The power regulator of claim 1, when the first power supply voltage overly increases, the scaled-down current has a value higher than a predetermined value.

4. A power regulator comprising:

a pass transistor configured to receive an unregulated first power supply voltage to generate a regulated output voltage varying depending upon a control signal, wherein the pass transistor comprises a first PMOS transistor having a gate coupled to an output terminal of the error amplifier, a source coupled to the first power supply voltage and a drain coupled to an output terminal of the power regulator;

a feedback circuit configured to generate a feedback signal;

an error amplifier configured to generate the control signal varying depending upon a voltage difference between a reference signal and the feedback signal; and a protection circuit configured to scale down a first current flowing through the pass transistor by a predetermined ratio to generate a second current and configured to change a voltage level of the control signal when the scaled-down second current has a value above a predetermined, wherein the protection circuit comprises:

a second PMOS transistor forming the current match transistor, the second PMOS transistor having a source coupled to the first power supply voltage;

a first NMOS transistor and a second NMOS transistor forming the mirror circuit, wherein the first NMOS transistor has a gate and drain commonly coupled to a drain of the second PMOS transistor, and a source coupled to a second power supply voltage, and wherein the second NMOS transistor has a gate coupled to a gate of the first NMOS transistor and a source coupled to the second power supply voltage;

a sensing resistor coupled between the first power supply voltage and a drain of the second NMOS transistor; and a third PMOS transistor having a source coupled to the first power supply voltage, a gate coupled to a drain of the second NMOS transistor and a drain coupled to a gate of the first PMOS transistor.

5. A power regulator comprising:

a pass transistor configured to receive an unregulated first power supply voltage to generate a regulated output voltage varying depending upon a control signal, wherein the pass transistor comprises a first PMOS transistor having a gate coupled to an output terminal of the error amplifier, a source coupled to the first power supply voltage and a drain coupled to an output terminal of the power regulator;

a feedback circuit configured to generate a feedback signal;

an error amplifier configured to generate the control signal varying depending upon a voltage difference between a reference signal and the feedback signal; and a protection circuit configured to scale down a first current flowing through the pass transistor by a predetermined ratio to generate a second current and configured to change a voltage level of the control signal when the scaled-down second current has a value above a predetermined, wherein the protection circuit comprises:

a second PMOS transistor forming the current match transistor, the second PMOS transistor having a source coupled to the first power supply voltage;

a third PMOS transistor having a source coupled to a drain of the second PMOS transistor, a gate coupled to a first node and a drain coupled to a second node;

a fourth PMOS transistor having a source coupled to a drain of the first PMOS transistor, and a gate and drain commonly coupled to the first node;

a first NMOS transistor and a second NMOS transistor forming the mirror circuit, wherein the first NMOS transistor has a gate and drain commonly coupled to the second node, and a source coupled to a second power supply voltage, and wherein the second NMOS transistor has a gate coupled to a gate of the first NMOS transistor and a source coupled to the second power supply voltage;

a third NMOS transistor having a gate coupled to a gate of the second NMOS transistor, a drain coupled to the first node and a source coupled to the second power supply voltage;

a sensing resistor coupled between the first power supply voltage and a drain of the second NMOS transistor; and a fifth PMOS transistor having a source coupled to the first power supply voltage, a gate coupled to a drain of the second NMOS transistor and a drain coupled to a gate of the first PMOS transistor.

6. The power regulator of claim 5, wherein the protection circuit further comprises a sixth PMOS transistor having a gate coupled to a gate of the second PMOS transistor, source coupled to the first power supply voltage and a drain coupled to the second node.

7. The power regulator of claim 5, wherein the protection circuit further comprises a trigger resistor coupled between the first power supply voltage and the second node.

8. An over-current protection circuit in a power regulator comprising:

a first PMOS transistor forming a pass transistor;

a second PMOS transistor having a gate coupled to a gate of the pass transistor and a source coupled to a first power supply voltage;

a first NMOS transistor having a gate and drain commonly coupled to a drain of the second PMOS transistor, and a source coupled to a second power supply voltage;

a second NMOS transistor having a gate coupled to a gate of the first NMOS transistor and a source coupled to the second power supply voltage;

a sensing resistor coupled between the first power supply voltage and a drain of the second NMOS transistor; and a third PMOS transistor having a source coupled to the first power supply voltage, a gate coupled to a drain of the second NMOS transistor and a drain coupled to a gate of the first PMOS transistor.

9. An over-current protection circuit in a power regulator comprising:

a first PMOS transistor forming a pass transistor;

a second PMOS transistor having a gate coupled to a gate of the pass transistor and a source coupled to a first power supply voltage;

a third PMOS transistor having a source coupled to a drain of the second PMOS transistor, a gate coupled to a first node and a drain coupled to a second node;

a fourth PMOS transistor having a source coupled to a drain of the first PMOS transistor, and a gate and drain commonly coupled to the first node;

a first NMOS transistor having a gate and drain commonly coupled to the second node, and a source coupled to a second power supply voltage;

a second NMOS transistor having a gate coupled to a gate of the first NMOS transistor and a source coupled to the second power supply voltage;

a third NMOS transistor having a gate coupled to a gate of the second NMOS transistor, a drain coupled to the first node and a source coupled to the second power supply voltage;

a sensing resistor coupled between the first power supply voltage and a drain of the second NMOS transistor; and a fifth PMOS transistor having a source coupled to the first power supply voltage, a gate coupled to a drain of the second NMOS transistor and a drain coupled to a gate of the first PMOS transistor.

10. The over-current protection circuit in a power regulator of claim 9, wherein the protection circuit further comprises a sixth PMOS transistor having a gate coupled to a gate of the second PMOS transistor, a source coupled to the first power supply voltage and a drain coupled to the second node.

11. The over-current protection circuit in a power regulator of claim 9, wherein the protection circuit further comprises a trigger resistor coupled between the first power supply voltage and the second node.

* * * * *